US010043362B2

(12) United States Patent
Smith

(10) Patent No.: US 10,043,362 B2
(45) Date of Patent: Aug. 7, 2018

(54) SECURITY ALARM SYSTEM

(71) Applicant: Leslie Smith, Las Vega, NV (US)

(72) Inventor: Leslie Smith, Las Vega, NV (US)

( * ) Notice: Subject to any disclaimer, the term of this patent is extended or adjusted under 35 U.S.C. 154(b) by 410 days.

(21) Appl. No.: 14/926,730

(22) Filed: Oct. 29, 2015

(65) Prior Publication Data

US 2017/0124823 A1 May 4, 2017

(51) Int. Cl.
*G08B 13/02* (2006.01)
*G08B 13/196* (2006.01)

(52) U.S. Cl.
CPC . *G08B 13/19695* (2013.01); *G08B 13/19669* (2013.01)

(58) Field of Classification Search
CPC ..... G08B 13/19695; G08B 13/19669
See application file for complete search history.

(56) References Cited

U.S. PATENT DOCUMENTS 5,463,595 A 10/1995 Rodhall et al.
5,555,454 A * 9/1996 Dees ..... G08B 25/10 340/332
5,619,185 A * 4/1997 Ferraro ..... G08B 13/1409 340/506
5,818,338 A * 10/1998 Ferraro ..... G08B 13/1409 340/568.1
5,867,099 A 2/1999 Keeter
5,890,797 A 4/1999 Bish
6,320,506 B1 * 11/2001 Ferraro ..... G08B 13/1409 315/129
6,933,854 B1 * 8/2005 Burgess ..... G08B 7/06 340/691.1
D546,997 S * 7/2007 Monroe ..... D26/51
9,819,910 B2 * 11/2017 Huang ..... H04N 7/183
2002/0014971 A1 * 2/2002 Ferraro ..... G08B 13/1409 340/689
2011/0115627 A1 * 5/2011 Smith ..... G08B 3/10 340/541
2015/0062337 A1 * 3/2015 Scalisi ..... H04M 1/0291 348/143
2015/0179031 A1 * 6/2015 Wallace ..... G08B 13/02 340/541

FOREIGN PATENT DOCUMENTS

WO WO2001013100 6/2001

* cited by examiner

*Primary Examiner* — Sathyanaraya V Perungavoor
*Assistant Examiner* — Howard D Brown, Jr.

(57) ABSTRACT

A security alarm system includes a security light that has a pair of sockets and a motion detector. The motion detector is electrically coupled to each of the sockets. The motion detector actuates each of the sockets when the motion detector detects motion. A first alarm is removably coupled to an associated one of the sockets such that the first alarm is in electrical communication with the associated socket. The first alarm emits an audible alarm when the motion detector detects motion. A second alarm is removably coupled to an associated one of the sockets such that the second alarm is in electrical communication with the associated socket. The second alarm records video footage when the motion detector detects motion.

6 Claims, 5 Drawing Sheets

SECURITY ALARM SYSTEM

BACKGROUND OF THE DISCLOSURE

Field of the Disclosure

The disclosure relates to security devices and more particularly pertains to a new security device for facilitating selective video surveillance of an area.

SUMMARY OF THE DISCLOSURE

An embodiment of the disclosure meets the needs presented above by generally comprising a security light that has a pair of sockets and a motion detector. The motion detector is electrically coupled to each of the sockets. The motion detector actuates each of the sockets when the motion detector detects motion. A first alarm is removably coupled to an associated one of the sockets such that the first alarm is in electrical communication with the associated socket. The first alarm emits an audible alarm when the motion detector detects motion. A second alarm is removably coupled to an associated one of the sockets such that the second alarm is in electrical communication with the associated socket. The second alarm records video footage when the motion detector detects motion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
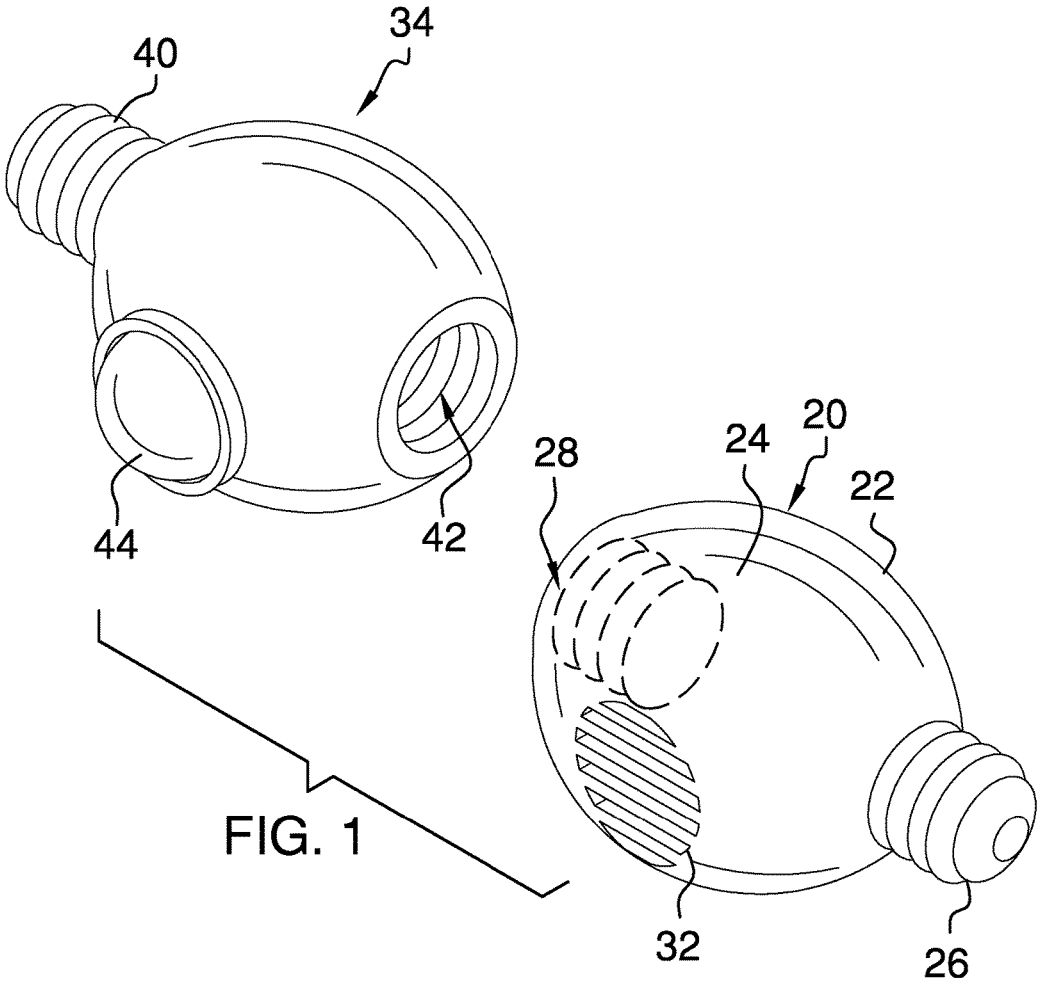
FIG. 1 is a perspective view of a security alarm system according to an embodiment of the disclosure.
Figure 2:
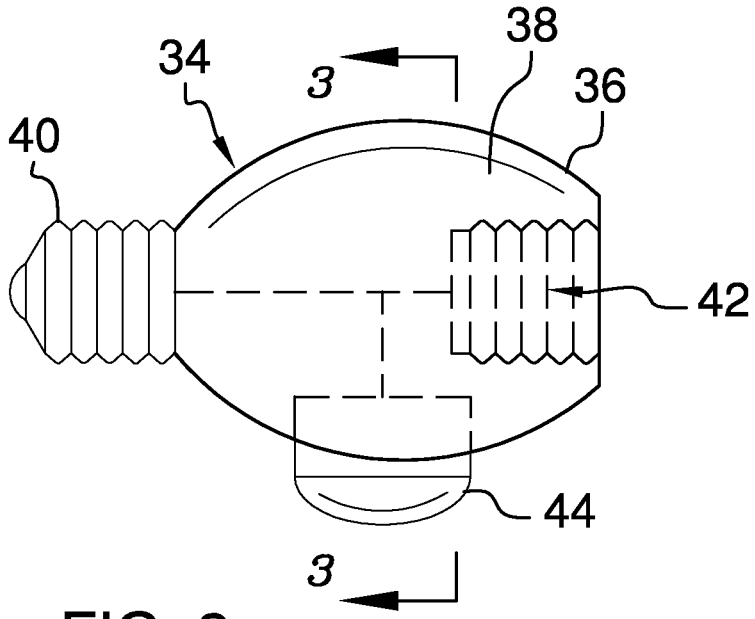
FIG. 2 is a right side view of an embodiment of the disclosure.
Figure 3:
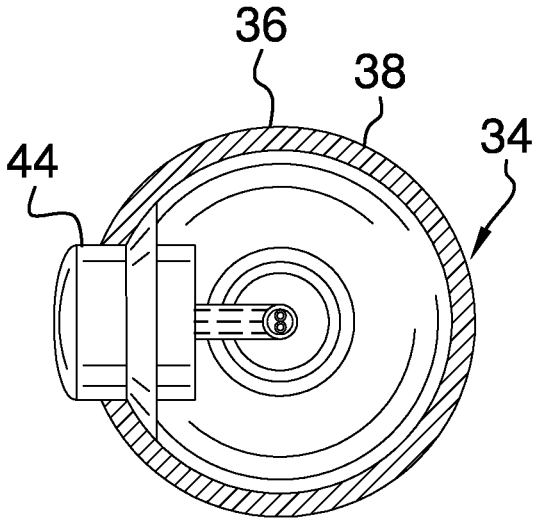
FIG. 3 is a cross sectional view taken along line 3-3 of FIG. 2 of an embodiment of the disclosure.
Figure 4:
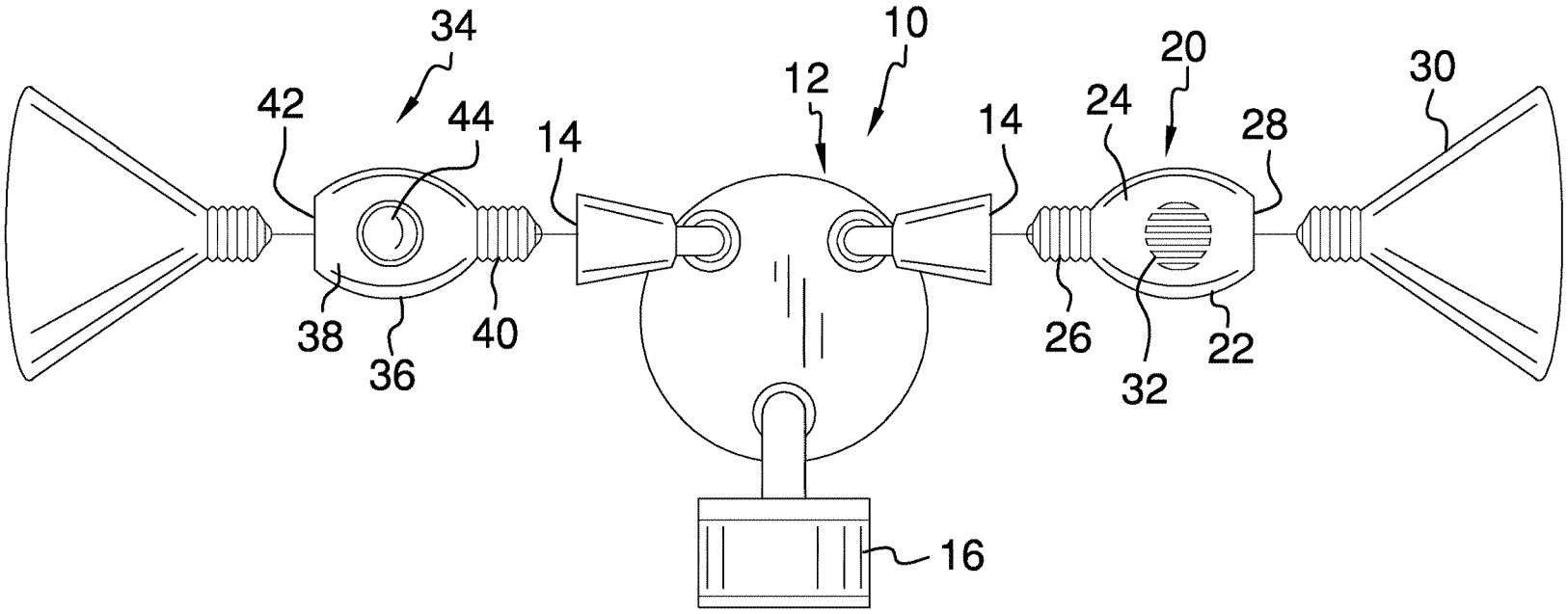
FIG. 4 is a perspective in-use view of an embodiment of the disclosure.

With reference now to the drawings, and in particular to FIGS. 1 through 7 thereof, a new security device embodying the principles and concepts of an embodiment of the disclosure and generally designated by the reference numeral 10 will be described.

As best illustrated in FIGS. 1 through 7, the security alarm system 10 generally comprises a security light 12 that has a pair of sockets 14 and a motion detector 16. The motion detector 16 is electrically coupled to each of the sockets 14. The motion detector 16 turns each of the sockets 14 on when the motion detector 16 detects motion. The security light 12 may be coupled to a structure 18 thereby facilitating the motion detector 16 to monitor activity in a selected area with respect to the structure 18. The structure 18 may be a house or the like. The motion detector 16 may be an electronic motion detector or the like and each of the sockets 14 may be a light bulb socket or the like.

A first alarm 20 is removably coupled to an associated one of the sockets 14 and the first alarm 20 is in electrical communication with the associated socket 14. The first alarm 20 emits an audible alarm when the motion detector 16 detects motion. The first alarm 20 comprises a housing 22 that has an outer wall 24. The outer wall 24 is continuous such that the outer wall 24 has an ovoid shape.

The outer wall 24 has a plug 26 extending outwardly therefrom. The plug 26 engages the associated socket 14 such that the first alarm 20 is removably coupled to the associated socket 14. The plug 26 is in electrical communication with the associated socket 14. The outer wall 24 has a socket 28 extending inwardly therein and the socket 28 corresponding to the first alarm 20 may have a light bulb 30 electrically coupled thereto. The socket 28 corresponding to the first alarm 20 may comprise a light bulb socket or the like. The plug 26 may comprise a light bulb plug or the like.

A speaker 32 is coupled to the outer wall 24. The speaker 32 is electrically coupled to the plug 26. Thus, the speaker 32 emits the audible alarm when the motion detector 16 detects motion. The speaker 32 may be an electronic speaker or the like.

A second alarm 34 is removably coupled to an associated one of the sockets 14 and the second alarm 34 is in electrical communication with the associated socket 14. The second alarm 34 records video footage when the motion detector 16 detects motion. The second alarm 34 comprises a housing 36 that has an exterior wall 38. The exterior wall 38 is continuous such that the exterior wall 38 has an ovoid shape.

The exterior wall 38 has a plug 40 extending outwardly therefrom. The plug 40 corresponding to the second alarm 34 engages the associated socket 14 such that the second alarm 34 is removably coupled to the associated socket 14. The plug 40 corresponding to the second alarm 34 may comprise a light bulb plug or the like. The exterior wall 38 has a socket 42 extending inwardly therein. The socket 42 corresponding to the second alarm 34 may have a light bulb electrically coupled thereto. The socket 42 corresponding to the second alarm 34 may comprise a light bulb socket or the like.

Figure 6:
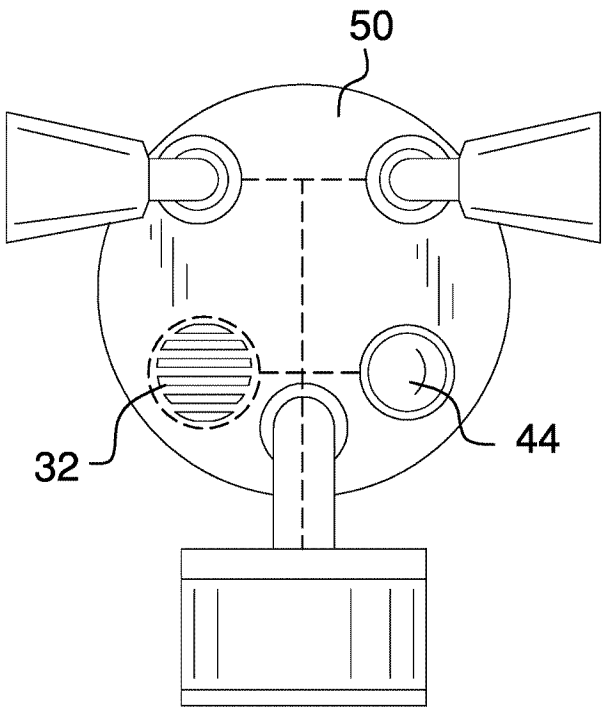
FIG. 6 is a front view of an alternative embodiment of the disclosure.
Figure 5:
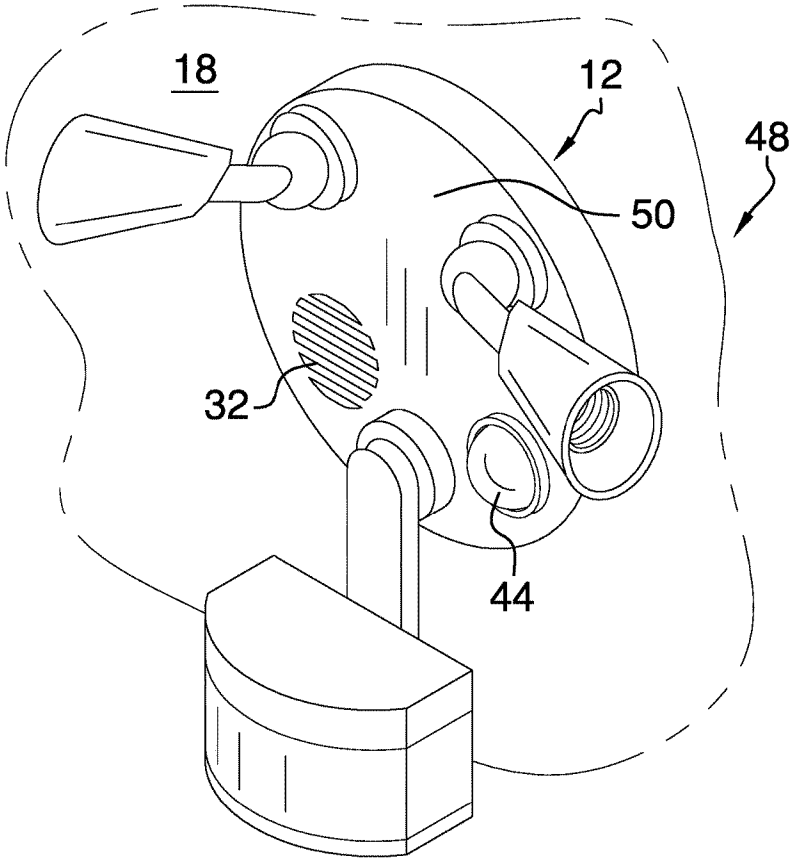
FIG. 5 is a perspective view of an alternative embodiment of the disclosure.
Figure 7:
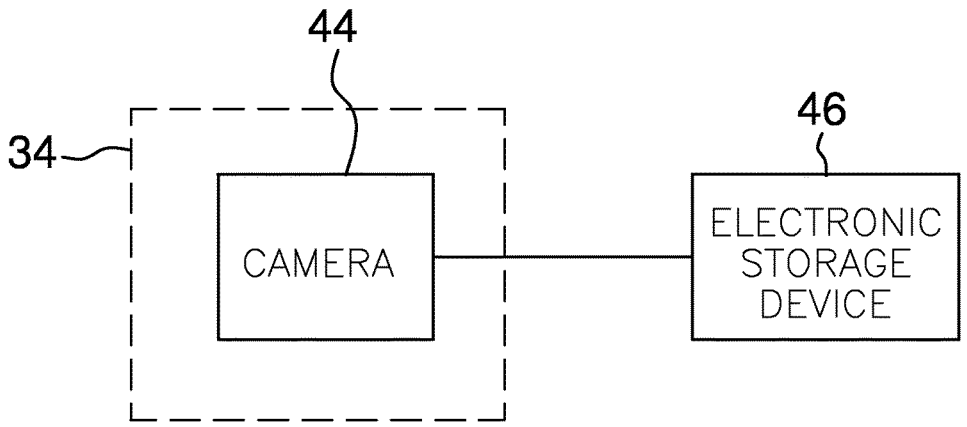
FIG. 7 is a schematic view of an embodiment of the disclosure.

A camera 44 is coupled to the exterior wall 38 and the camera 44 selectively records video of the area with respect to the structure 18. The camera 44 is electrically coupled to the plug 40 corresponding to the second alarm 34. Thus, the camera 44 records the video when the motion detector 16 detects motion. The camera 44 is in electrical communication with an extrinsic electronic storage device 46. The camera 44 may be a digital camera or the like. In an alternative embodiment 48 as shown in FIGS. 5 and 6, each of the speaker 32 and the camera 44 are coupled to a front side 50 of the security light 12. Each of the speaker 32 and the camera 44 are electrically coupled to the motion detector.

In use, the plug 26,40 corresponding to each of the first alarm 20 and the second alarm 34 are screwed into the associated socket 14 on the security light 12. Each of the first alarm 20 and the second alarm 34 are manipulated to expose the speaker 32 and the camera 44. The camera 44 is electrically coupled to the extrinsic electronic storage device 46 through any conventional means such as an electrical conductor or the like. The motion detector 16 actuates each of the speaker 32 and the camera 44 when the motion detector 16 detects motion. Thus, the audile alarm may frighten an intruder and the camera 44 captures video footage of the intruder.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A security alarm system comprising:

a security light having a pair of sockets and a motion detector, said motion detector being electrically coupled to each of said sockets wherein said motion detector is configured to turn on each of said sockets when said motion detector detects motion, said security light being configured to be coupled to a structure thereby facilitating said motion detector to monitor activity in a selected area with respect to the structure;

a first alarm being removably coupled to an associated one of said sockets such that said first alarm is in electrical communication with said associated socket, said first alarm being configured to emit an audible alarm when said motion detector detects motion, said first alarm comprising a housing having an outer wall, said outer wall being continuous such that said outer wall has an ovoid shape, said outer wall having a plug extending outwardly therefrom, said plug electrically engaging said associated socket such that said first alarm is removably coupled to said associated socket, said outer wall having a socket extending inwardly therein, said socket corresponding to said first alarm being electrically coupled to said associated socket of said security light wherein said socket of said outer wall of said first alarm is configured to have a light bulb being electrically coupled thereto; and a second alarm being removably coupled to an associated one of said sockets such that said second alarm is in electrical communication with said associated socket, said second alarm being configured to record video footage when said motion detector detects motion.

2. The system according to claim 1, further comprising a speaker being coupled to said outer wall, said speaker being electrically coupled to said plug wherein said speaker is configured to emit the audible alarm when said motion detector detects motion.

3. The system according to claim 1, wherein said second alarm comprises a housing having an exterior wall, said exterior wall being continuous such that said exterior wall has an ovoid shape, said exterior wall having a plug extending outwardly therefrom, said plug corresponding to said second alarm engaging said associated socket such that said second alarm is removably coupled to said associated socket.

4. The system according to claim 3, wherein said exterior wall has a socket extending inwardly therein, said socket corresponding to said second alarm being configured to have a light bulb being electrically coupled thereto.

5. The system according to claim 4, further comprising a camera being coupled to said exterior wall wherein said camera is configured to record video of the area with respect to the structure, said camera being electrically coupled to said plug corresponding to said second alarm wherein said camera is configured to record the video when said motion detector detects motion, said camera being configured to be in electrical communication with an extrinsic electronic storage device.

6. A security alarm system comprising:

a security light having a pair of sockets and a motion detector, said motion detector being electrically coupled to each of said sockets wherein said motion detector is configured to turn on each of said sockets when said motion detector detects motion, said security light being configured to be coupled to a structure thereby facilitating said motion detector to monitor activity in a selected area with respect to the structure;

a first alarm being removably coupled to an associated one of said sockets such that said first alarm is in electrical communication with said associated socket, said first alarm being configured to emit an audible alarm when said motion detector detects motion, said first alarm comprising:

a housing having an outer wall, said outer wall being continuous such that said outer wall has an ovoid shape, said outer wall having a plug extending outwardly therefrom, said plug engaging said associated socket such that said first alarm is removably coupled to said associated socket, said outer wall having a socket extending inwardly therein, said socket corresponding to said first alarm being electrically coupled to said associated socket of said security light wherein said socket of said outer wall of said first alarm is configured to have a light bulb being electrically coupled thereto, and a speaker being coupled to said outer wall, said speaker being electrically coupled to said plug wherein said speaker is configured to emit the audible alarm when said motion detector detects motion;

a second alarm being removably coupled to an associated one of said sockets such that said second alarm is in electrical communication with said associated socket, said second alarm being configured to record video footage when said motion detector detects motion, said second alarm comprising:

a housing having an exterior wall, said exterior wall being continuous such that said exterior wall has an ovoid shape, said exterior wall having a plug extending outwardly therefrom, said plug corresponding to said second alarm engaging said associated socket such that said second alarm is removably coupled to said associated socket, said exterior wall having a socket extending inwardly therein, said socket corresponding to said second alarm being configured to have a light bulb being electrically coupled thereto, and a camera being coupled to said exterior wall wherein said camera is configured to record video of the area with respect to the structure, said camera being electrically coupled to said plug corresponding to said second alarm wherein said camera is configured to record the video when said motion detector detects motion, said camera being configured to be in electrical communication with an extrinsic electronic storage device.

* * * * *